US006035610A

United States Patent [19]

Vonderhorst et al.

[11] Patent Number: 6,035,610

[45] Date of Patent: Mar. 14, 2000

[54] METHOD AND APPARATUS FOR SEPARATING AND INSERTING ITEMS PACKAGED IN A BANDOLIER

[75] Inventors: James P. Vonderhorst, Parkton; William M. Berg, Fallston, both of Md.

[73] Assignee: Exact Packaging Incorporated, New Freedom, Pa.

[21] Appl. No.: 09/167,820

[22] Filed: Oct. 7, 1998

[51] Int. Cl.[7] ..... B65B 63/00

[52] U.S. Cl. ..... 53/435; 53/238; 53/474; 53/520; 83/945

[58] Field of Search ..... 221/25, 30; 83/945; 53/157, 238, 435, 445, 474, 520

[56] References Cited

U.S. PATENT DOCUMENTS

| | | | |
|---|---|---|---|
| 2,259,866 | 10/1941 | Stokes . | |
| 3,543,475 | 12/1970 | Moon | 53/520 X |
| 4,726,171 | 2/1988 | Kreager et al. | 53/474 X |
| 4,729,210 | 3/1988 | Galliano . | |
| 4,752,002 | 6/1988 | Takahashi et al. | 206/390 X |
| 4,897,273 | 1/1990 | Kotaki et al. | 53/474 X |
| 4,907,393 | 3/1990 | Omori et al. | 53/238 X |
| 5,079,901 | 1/1992 | Kotsiopoulos | 53/435 |
| 5,090,591 | 2/1992 | Long . | |
| 5,335,479 | 8/1994 | Lemke et al. . | |
| 5,390,475 | 2/1995 | Iwauchi et al. | 53/474 |
| 5,425,217 | 6/1995 | Lobash et al. | 53/435 |
| 5,549,233 | 8/1996 | Clauser | 225/100 |
| 5,752,365 | 5/1998 | Johnson et al. | 53/435 |
| 5,845,462 | 12/1998 | Kuehl et al. | 53/435 |

*Primary Examiner*—Daniel B. Moon
*Attorney, Agent, or Firm*—Leonard Bloom

[57] ABSTRACT

An apparatus for separating individual items from a bandolier of adjacent items have a seam between the items. A pair of upper jaws and a pair of lower jaws open and close horizontally to clamp and release the respective seam. The pair of lower jaws pull the bandolier downwardly through the opened pair of upper jaws. The seam is cut while the pair of upper jaws close to grasp an adjacent seam. The pair of lower jaws open to release the separated item to a delivery system and the pair of lower jaws move upwardly to be adjacent to, and below, the pair of upper jaws. The pair of lower jaws close and the sequence is repeated. At least one sensor identifies an identification feature on the items and transmits signals to a control unit to actuate movement of the pair of upper jaws and the pair of lower jaws. Preferably, a second sensor system assures that separation is only at the respective seams. A method of use is disclosed.

26 Claims, 18 Drawing Sheets

METHOD AND APPARATUS FOR SEPARATING AND INSERTING ITEMS PACKAGED IN A BANDOLIER

FIELD OF THE INVENTION

The present invention relates to apparatus and method for separating and inserting items into products, and more particularly, to an apparatus and method for inserting coupons, toys, product samples and the like into packages.

BACKGROUND OF THE INVENTION

In the prior art, manufacturers of various snacks as well as manufacturers of candies, cereals, or other products often place a coupon into the bag or box during the packaging process. The coupons are formed as a reel of coupons or as a continuous fold, and a pair of breaking rollers are adapted to separate adjacent coupons; thereafter, the individual coupon is directed into the package prior to the package-filling and sealing process. Most commonly, the coupons are used with food packages but are not limited to food.

Being a two-dimensional (2-D) item, the coupons may be separated and subsequently fed into the respective packages at moderate speeds without repeated jamming.

Problems have been encountered, when attempting to sever a three-dimensional (3-D) premium item from a chain, strip or bandolier of 3-D items and directing the item into a package during the packaging process.

For example, the package may comprise a bag of potato chips, pretzels, nachos or the like; and the 3-D item may consist of a small sealed pouch containing a condiment such as salsa or ketchup or, possibly, a sample of a different snack intended for market research purposes. These items are commonly called premium items.

The premiums are frequently, but not necessarily, overwrapped into a bandolier for indexing. The premium item may comprise an item such as a toy intended for a child. In this case, for hygienic reasons and to meet U.S. Food and Drug Administration requirements, or to prevent contamination or inadvertent injury to the child, the toy or other item may be "overwrapped" that is, sealed within a plastic sleeve or pouch. Typically, these products are produced by an overseas manufacturer and shipped in bulk to an "overwrapper" who, in turn, produces a continuous bandolier of overwrapped items. Within the bandolier, adjacent items are separated by a seam which is usually heat-sealed.

Due to cost considerations, the overwrap is made with the least expensive material possible which may result in problems in that the individual premium items may not be completely sealed and may be non-uniform in orientation within the overwrap. The bandolier of items frequently has very broad tolerances.

Regardless of the particular 3-D item and its intended purpose, and whether or not the 3-D item is overwrapped, and despite the technical sophistication and the highly developed state-of-the-art in the packaging industry, the 3-D item thickness, length, size and/or configuration makes it extremely difficult to continuously feed these items, one by one, into the packages under standard industry production rates.

The apparatus and methods of making container packages in continuous bandoliers or strips and separating individual units from the strip have been disclosed in earlier patents.

Generally, the bandoliers may be classified into three types:

1. A perforated seam is formed between the individual units. Since the plastic of the bandolier is comparatively thin for purposes of economy, the seam may inadvertently tear as the bandolier is being pulled, processed and introduced into the separating apparatus.
2. A hole or slot is formed in the seam and indexed on a pin feed to align the bandolier prior to cutting the seam with a knife. This requires a more complex apparatus with more moving parts.
3. An uninterrupted seam is formed between the individual units and a knife edge is used to sever the seam.

Most of the prior art has been directed to the formation of bags or packages which use clamping or sealing tools to form seams between individual units. Examples of these are in U.S. Pat. No. 2,259,866 Stokes, U.S. Pat. No. 4,729,210 Galliano and U.S. Pat. No. 5,335,479 Lemke et al.

Long in U.S. Pat. No. 5,090,591 does not use a bag-making apparatus but is directed to an article dispenser. The patent discloses a dispenser for a continuous strip of articles which has two grippers with cantilevered arms, one gripper positioned on each side of the strip. The grippers move upstream and downstream to advance the strip and one gripper gripping the end article moves through the open arms of the other gripper. This is similar to the bagging apparatus of Galliano which has been adapted to separation. The device is for continuous motion of the strip and is geared for high speed operation. The device is complex because of the speed-matching devices and the number of moving parts and is comparatively expensive. Also, potential problems arise when used in an adverse environment such as the packaging of potato chips where there is heat, grease and particulates, the durability and reliability is reduced.

BRIEF SUMMARY OF THE INVENTION

Accordingly, it is an object of the present invention to provide a unit which can separate and insert 2-D and 3-D items in an actual production environment, such as in a food manufacturing plant.

It is another object to alleviate the deficiencies and disadvantages of the prior art by providing an apparatus and a method for quickly severing an item from its bandolier for subsequent insertion into a package at standard industry production rates, without jamming, and with inherent flexibility.

It is a further object of the present invention to provide an apparatus which is quite flexible to quickly accommodate different lengths, thicknesses, sizes and/or configurations of various 2-D and 3-D items without substantial changeover of equipment and can be used with a wide variety of items to be inserted into most types of packages.

The present invention has particular utility in a packaging apparatus, wherein a bandolier of items is fed into the machine, each of the items having an approximate length; wherein two adjacent items have a seam therebetween; and wherein the individual items are separated, one-by-one, from the bandolier and are dispensed for insertion into respective packages. The apparatus can be easily configured to handle bandoliers of items of any practical size. The apparatus is reliable, rapid and relatively inexpensive.

In accordance with the teachings of the present invention, there is disclosed a packaging apparatus, wherein a bandolier of items is fed into the apparatus, each of the items having a given length. Two adjacent items have a seam therebetween. Individual items are separated by separating means, one-by-one, from the bandolier and are dispensed for insertion into respective packages. The separating means include a pair of separated opposed upper jaws and a pair of separated opposed lower jaws. The pair of lower jaws have a cutting means contained therein. The pairs of jaws each have respective jaw members disposed on opposite faces of the bandolier of items. Means are provided for moving the separate upper jaw members to reciprocate horizontally with respect to each other. The upper jaw members alternately close and open to clamp and release the respective seam between adjacent items. Means are provided to move the separate lower jaw members to reciprocate horizontally with respect to each other. The lower jaw members alternately close and open to clamp and release the respective seam between adjacent items. The pair of lower jaws move vertically downwardly and upwardly with respect to the pair of upper jaws. At least one sensor is disposed adjacent to the bandolier of items and is connected to a control unit to control movement of both pairs of jaws. The pair of lower jaws clamp a respective seam on an item and move vertically downwardly from the opened pair of upper jaws, pulling the bandolier of items a predetermined distance. The seam is cut by the cutting means. The pair of upper jaws close. The pair of lower jaws open and release the cut-off item and the item is transported for insertion into the respective package. The pair of lower jaws move vertically upwardly adjacent to and below the pair of upper jaws and clamp a respective seam between adjacent items. The sequence is repeated.

In addition, there is disclosed a method for using the apparatus.

These and other objects of the present invention will become apparent from a reading of the following specification taken in conjunction with the enclosed drawings.

DESCRIPTION

Figure 1:
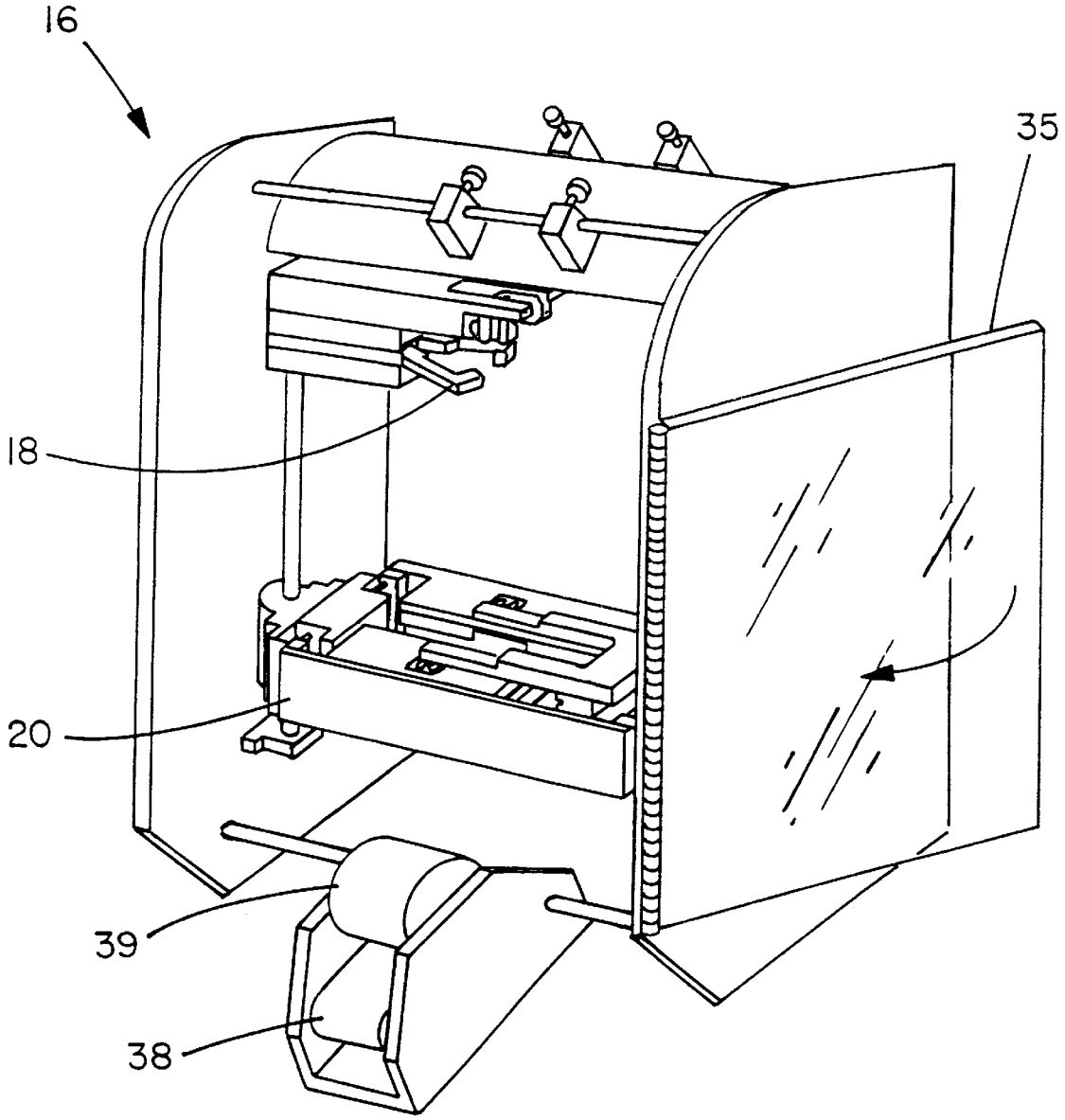
FIG. 1 is a perspective view of the apparatus of the present invention having a protective cover.

Referring now to FIGS. 1–9, premium items 10 are individually packaged and formed in a continuous bandolier or chain 12 with a seam 14 between the adjacent items 10. Each item 10 has respective opposite faces 15 between the seams 14. The length of the item 10 is dependent upon the nature of the premium. The bandolier or chain 12 of items 10 usually has only one type of premium throughout the entire bandolier or chain 12. However, the type of premium frequently is not the same in other bandoliers and, consequently, the length of the item 10 and the distance between seams may vary from bandolier to bandolier. As will be understood, and described subsequently, the present invention is capable of accommodating premiums of different lengths and the respective chain associated with each type of premium. The present invention severs seams within the range of 1½ inches to 5 inches. A larger version of the apparatus accommodates seams in the range of 3 inches to 10 inches.

Figure 10:
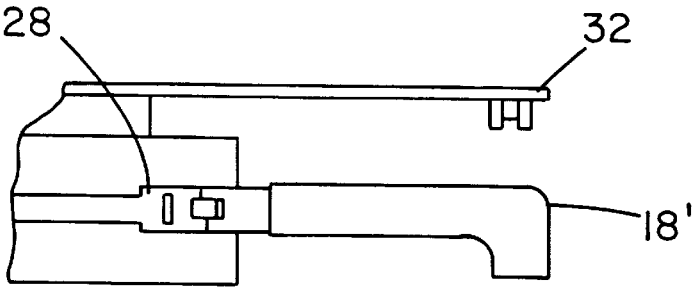
FIG. 10 is a side elevation view of the upper jaws.
Figure 11:
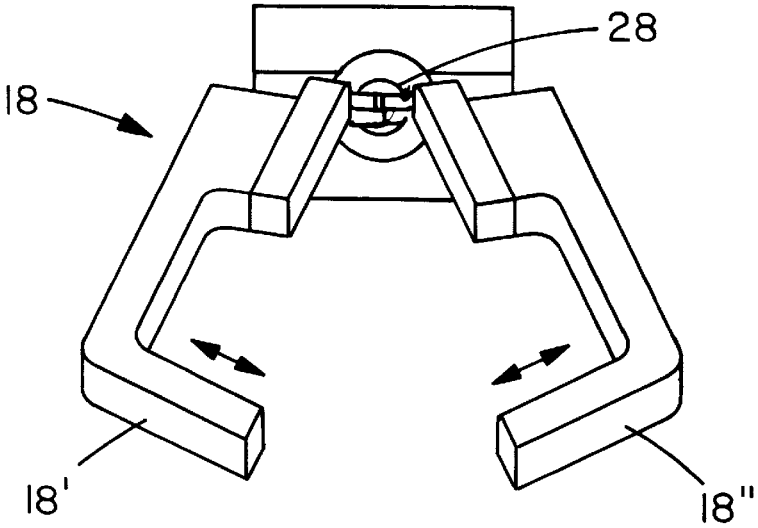
FIG. 11 is a perspective view showing movement of both upper jaw members with respect to one another.
Figure 12:
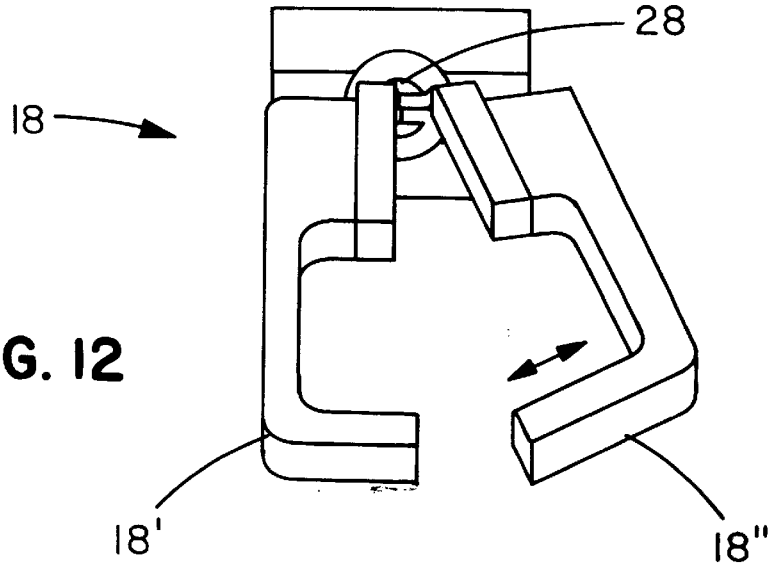
FIG. 12 is a top plan view showing movement of one of the upper jaw members toward the fixed other upper jaw member.
Figure 13:
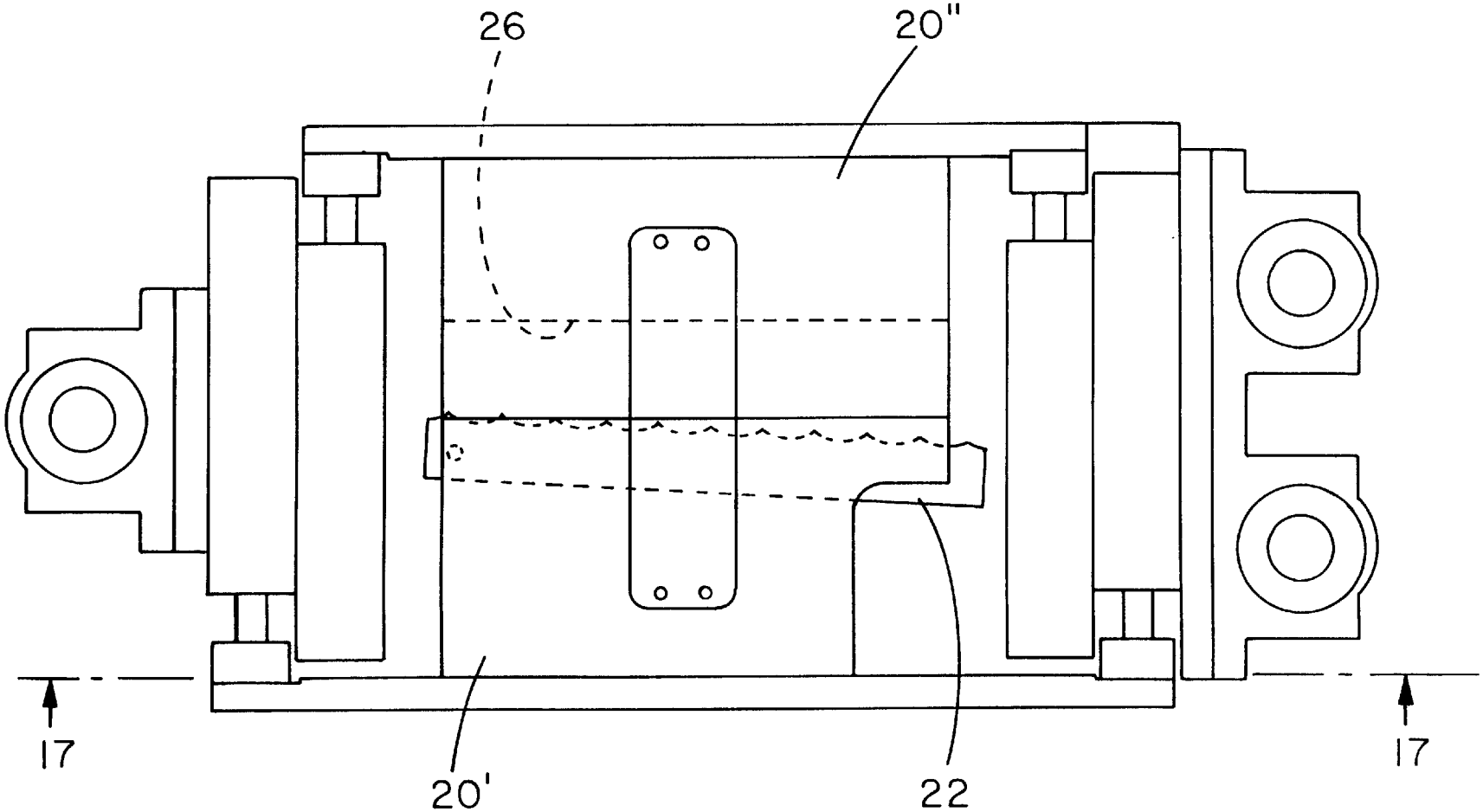
FIG. 13 is a top plan view showing the lower jaws closed with the cutting means (in broken lines) retracted into one of the lower jaw members.
Figure 14:
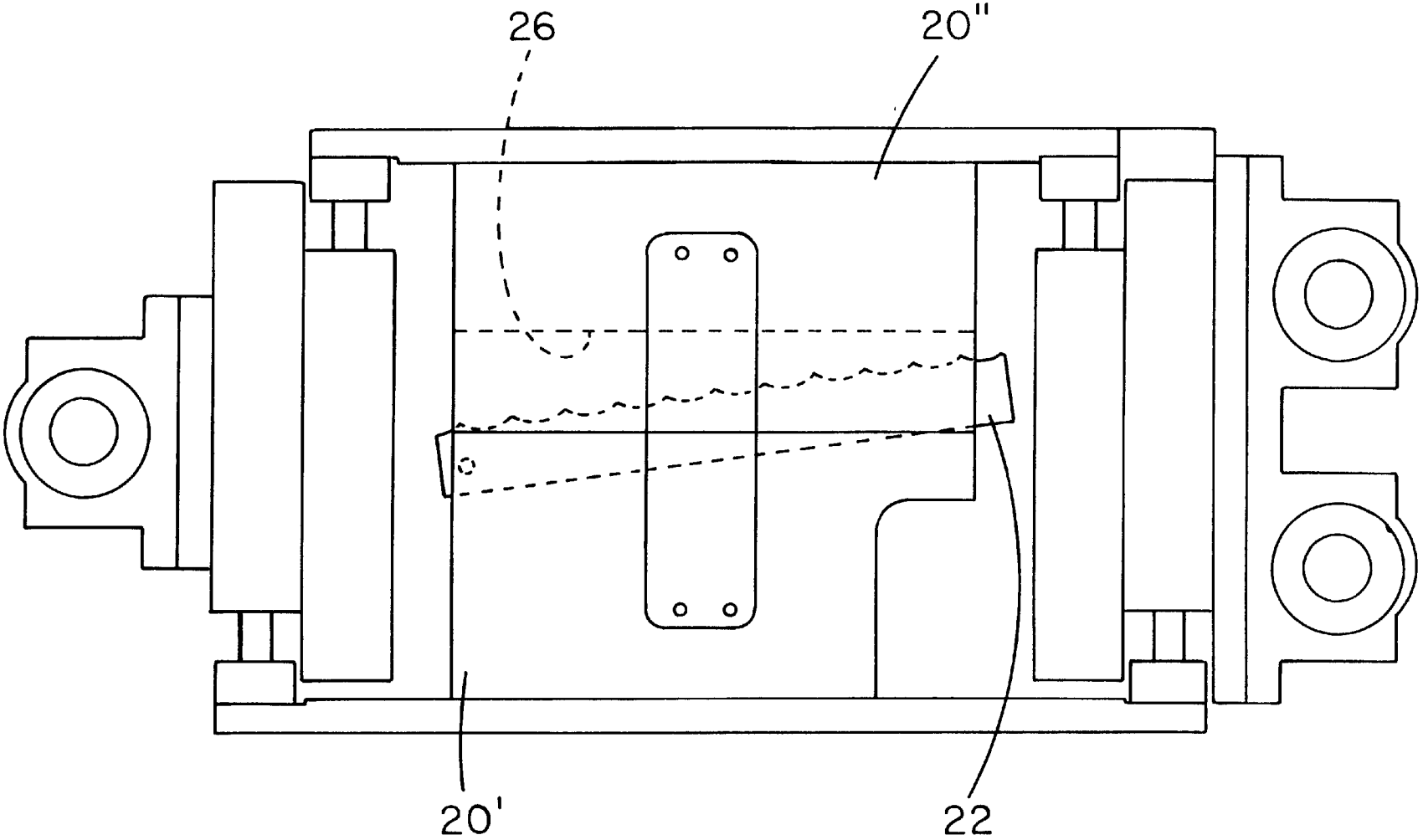
FIG. 14 is a top plan view showing the lower jaws closed with the cutting means cutting of the seam.
Figure 15:
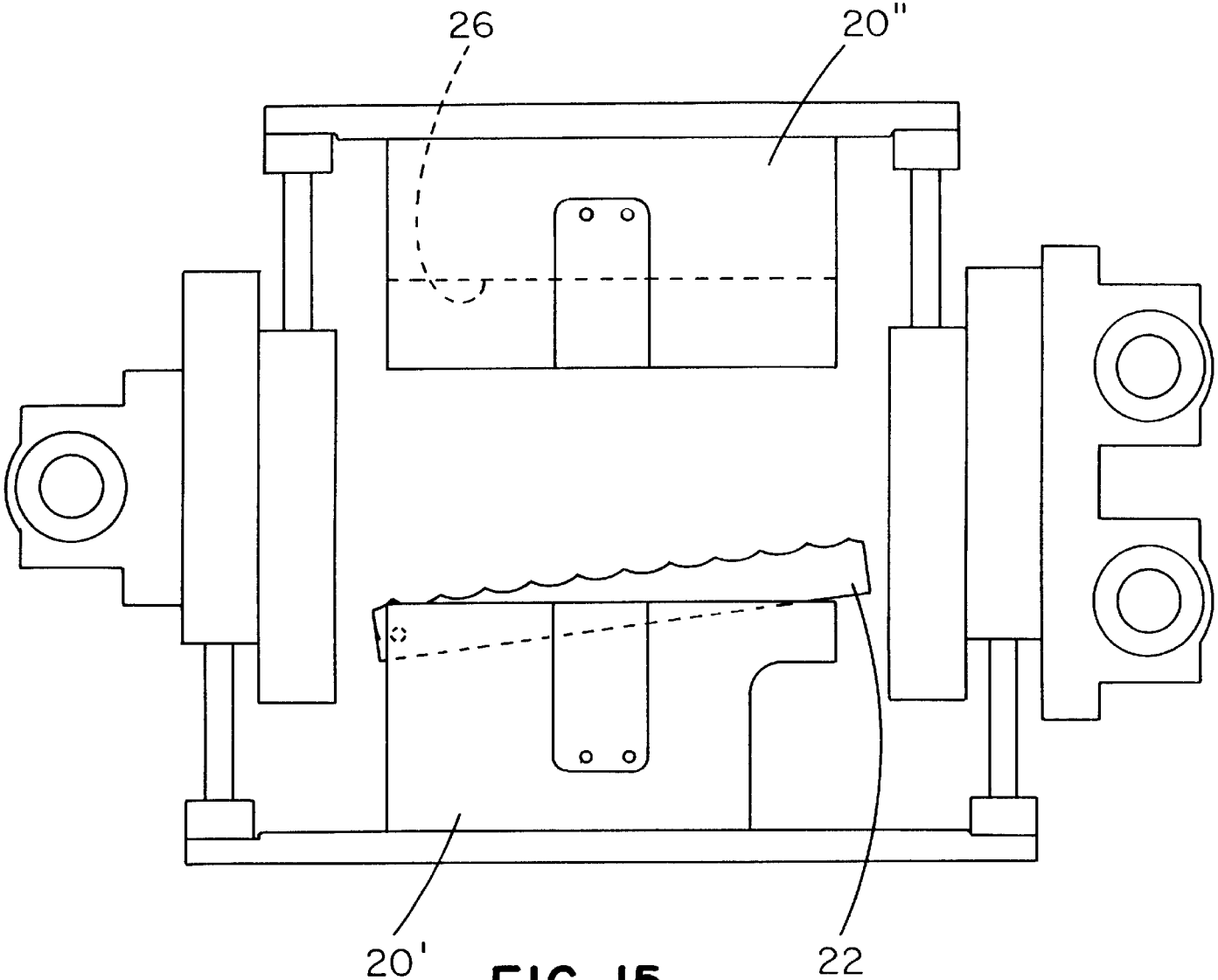
FIG. 15 is a top plan view showing the lower jaws opened with the cutting means extended to contact the cut-off item.
Figure 16:
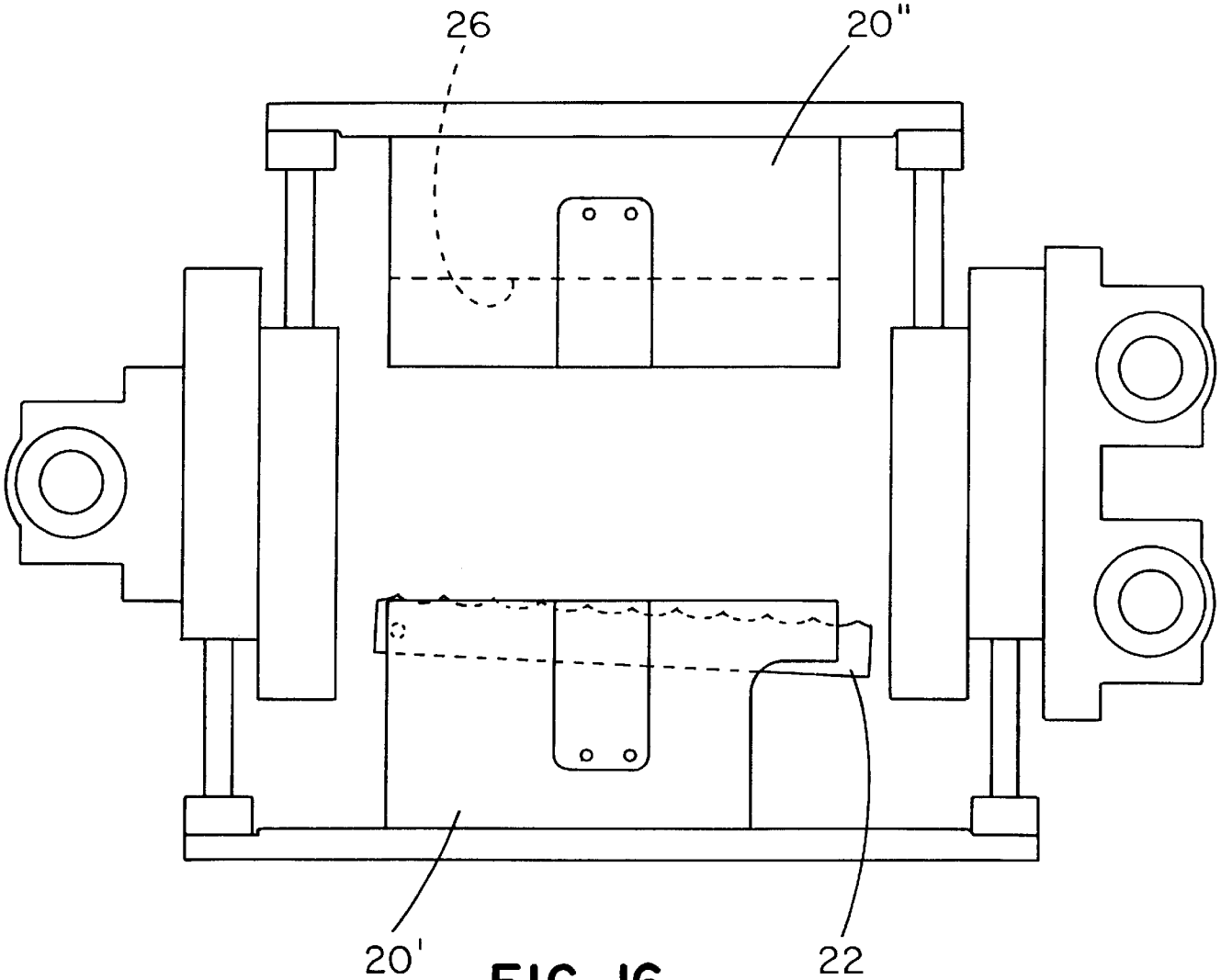
FIG. 16 is a top plan view showing the lower jaws opened and the cutting means retracted as the lower jaws are at bottom dead center of movement.
Figure 17:
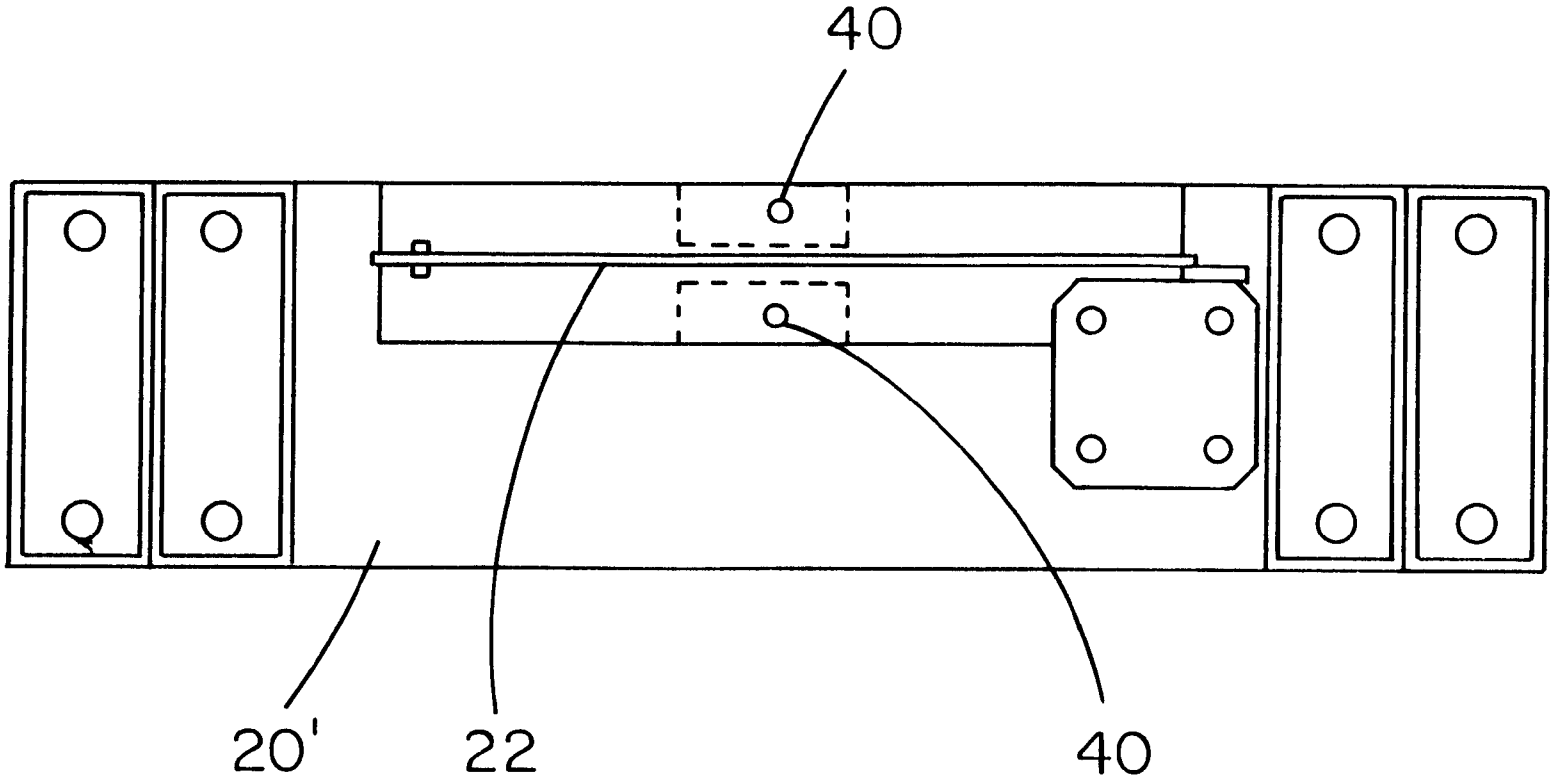
FIG. 17 is a cross-sectional view taken along the lines 17—17 of FIG. 13.
Figure 18:
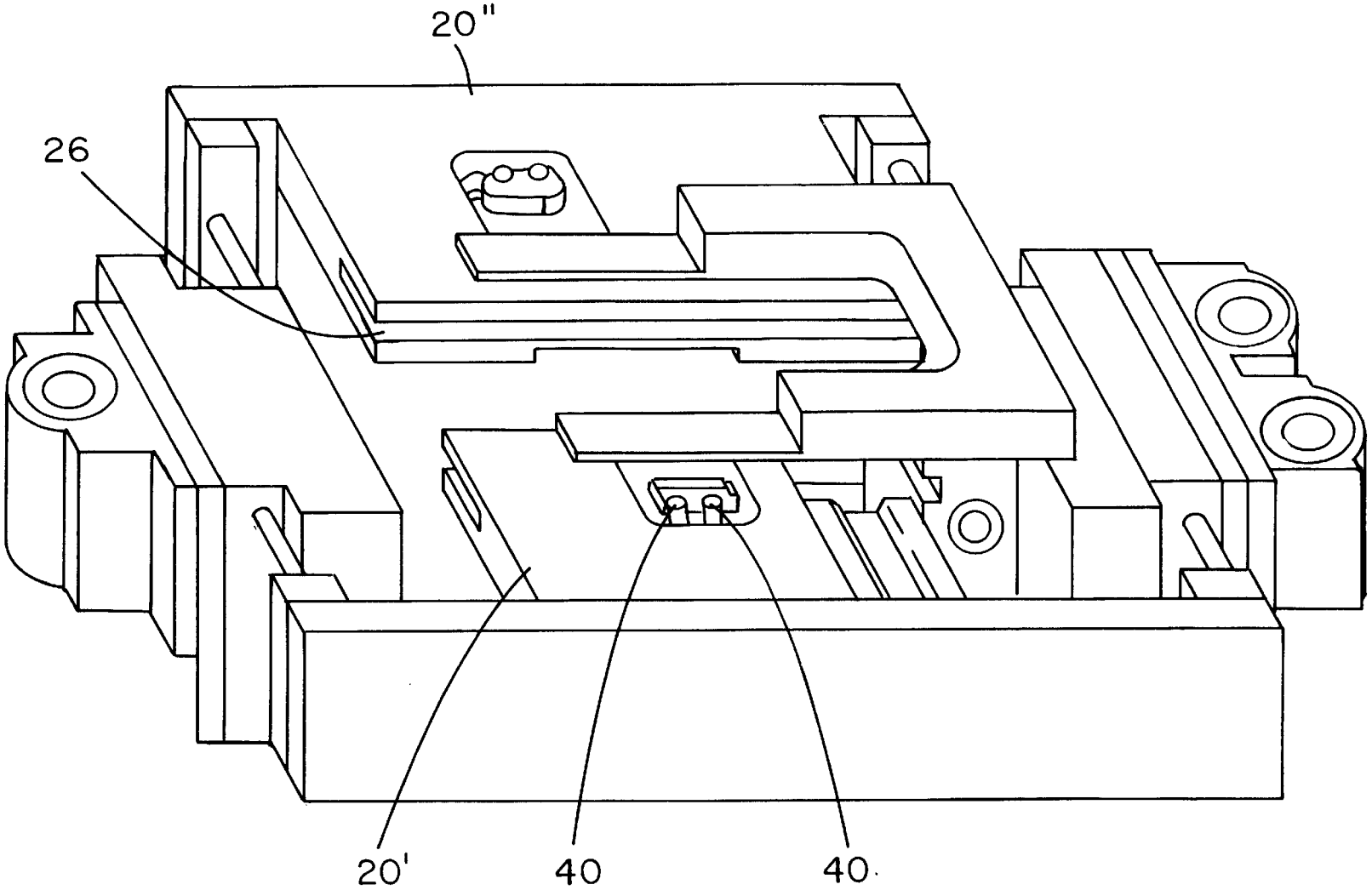
FIG. 18 is a perspective view of the pair of lower jaws in an opened position.

The bandolier 12 of items 10 is introduced into the apparatus 16 of the present invention. The apparatus 16 has a pair of separated opposed upper jaws 18 having jaw members 18' and 18" and a pair of separated opposed lower jaws 20 having jaw members 20' and 20". Both the pair of upper jaw member 18', 18" and the pair of lower jaw members 20', 20" reciprocate horizontally with respect to each other. Both pairs of jaws 18, 20 may alternately close and open to clamp and release the respective seam 14 between items (FIGS. 10–12).

Additionally, the pair of lower jaws 20 move vertically downwardly and upwardly with respect to the pair of upper jaws 18. Further, the pair of lower jaws 20 has a cutting means 22 contained therein. Each jaw member 20', 20" of the pair of lower jaws 20 has opposed bifurcated arms 24. The cutting means 22 is disposed between the bifurcated arms 24 on one of the lower jaw members 20' and preferably a void 26 is formed between the bifurcated arms of the other of the lower jaw members 20". The cutting means 22 may be a movable knife, a serrated edge, a pair of blades, a hot wire, a laser beam or other cutting means known to persons skilled in the art. When the cutting means 22 is a moveable knife or serrated edge, the cutting means moves toward the seam 14 held in the pair of lower jaws 20 and swiftly cuts the seam 14. The knife 22 extends through the seam 14 into the void 26 in the opposed jaw and retracts. The knife may be pivoted at one end and cut one edge of the seam 14 before cutting the opposite edge of the seam 14 (FIGS. 13–18).

First means 28 are provided to move the pair of upper jaw members 18', 18" to reciprocate horizontally with respect to each other. Both upper jaw members 18', 18" may be moved or only one of the upper jaw members may be moved. Movement must be sufficient to enable a 3-D item to pass through the opened jaw members. The first means 28 may be mechanical, electronic, hydraulic, pneumatic or a combination thereof. Similarly, second means 30 are provided to move the pair of lower jaw members 20', 20" to reciprocate horizontally with respect to each other. The lower jaw members 20, 20" must open sufficiently to enable a 3-D item to pass through the opened jaw members. The second means 30 also move the pair of lower jaws 20 vertically downwardly and upwardly with respect to the pair of upper jaws 18 and substantially parallel to the vertical bandolier 12 of items 10. The second means 30 may be mechanical, electronic, hydraulic, pneumatic, or a combination thereof.

At least one sensor 32 is disposed adjacent to the bandolier 12 of items 10. The at least one sensor 32 may be optical, electronic or of another type known to persons skilled in the art. The at least one sensor 32 identifies a feature of the item 10 or of the bandolier 12. This may be the respective leading or trailing edge of the item 10 or a registration mark 36 on each item 10 or on each seam 14. When the at least one sensor 32 senses the identification feature, a signal is sent to a control unit 34. Preferably, the control unit 34 is electronic and transmits coded electronic information to all other components of the apparatus 16 which must operate in a coordinated manner.

Preferably, a hinged panel 35 is connected to the front of the apparatus 16 to reduce the ingress of dirt and grease, for the safety of the operator, and in addition, to protect the operating components of the apparatus 16. Preferably, the panel 35 is transparent.

When the apparatus 16 is operating as will be described, an item 10' is separated from the end of the bandolier 12 and is transported by a delivery system for insertion into respective packages. Preferably, the delivery system is a conveyor means 38 and a rotating, motor driven roller 39. The roller 39 "floats" above the conveyor means 38 in that the roller is movable to drive the items without damaging the contents. The separated item 10' falls on the conveyor means 38 and is transported between the roller 39 and the conveyor means 38 and directed to the opened package. The opened package may be a bag, box, envelope or other package in which a premium is to be inserted. Alternately, the separated item 10 may be directly inserted into the respective package without transport.

Figure 2:
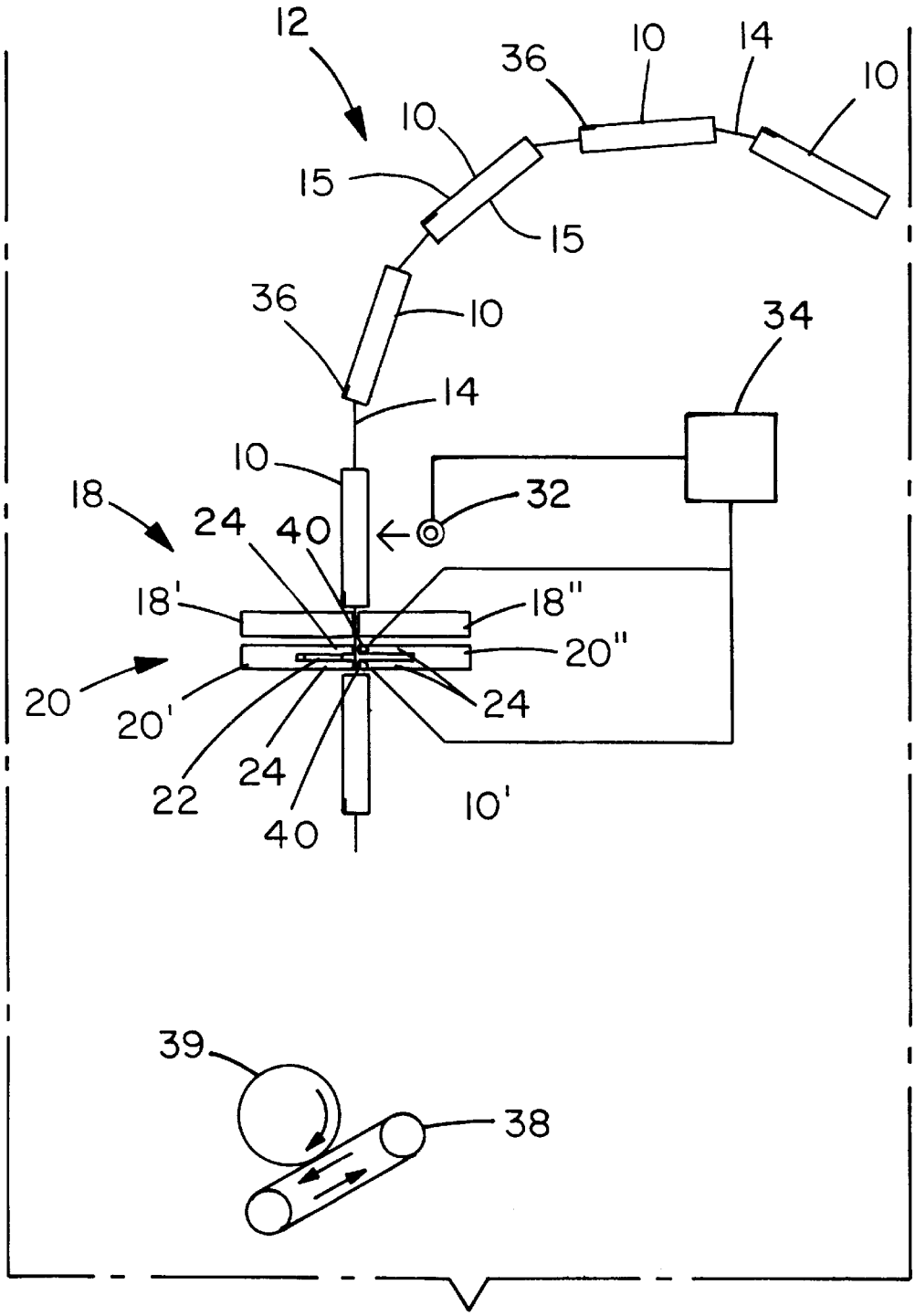
FIG. 2 is a diagram showing the apparatus of the present invention at the beginning of a cycle of separating an individual item from a bandolier of items. The length of the seam has been expanded for ease of illustration.
Figure 3:
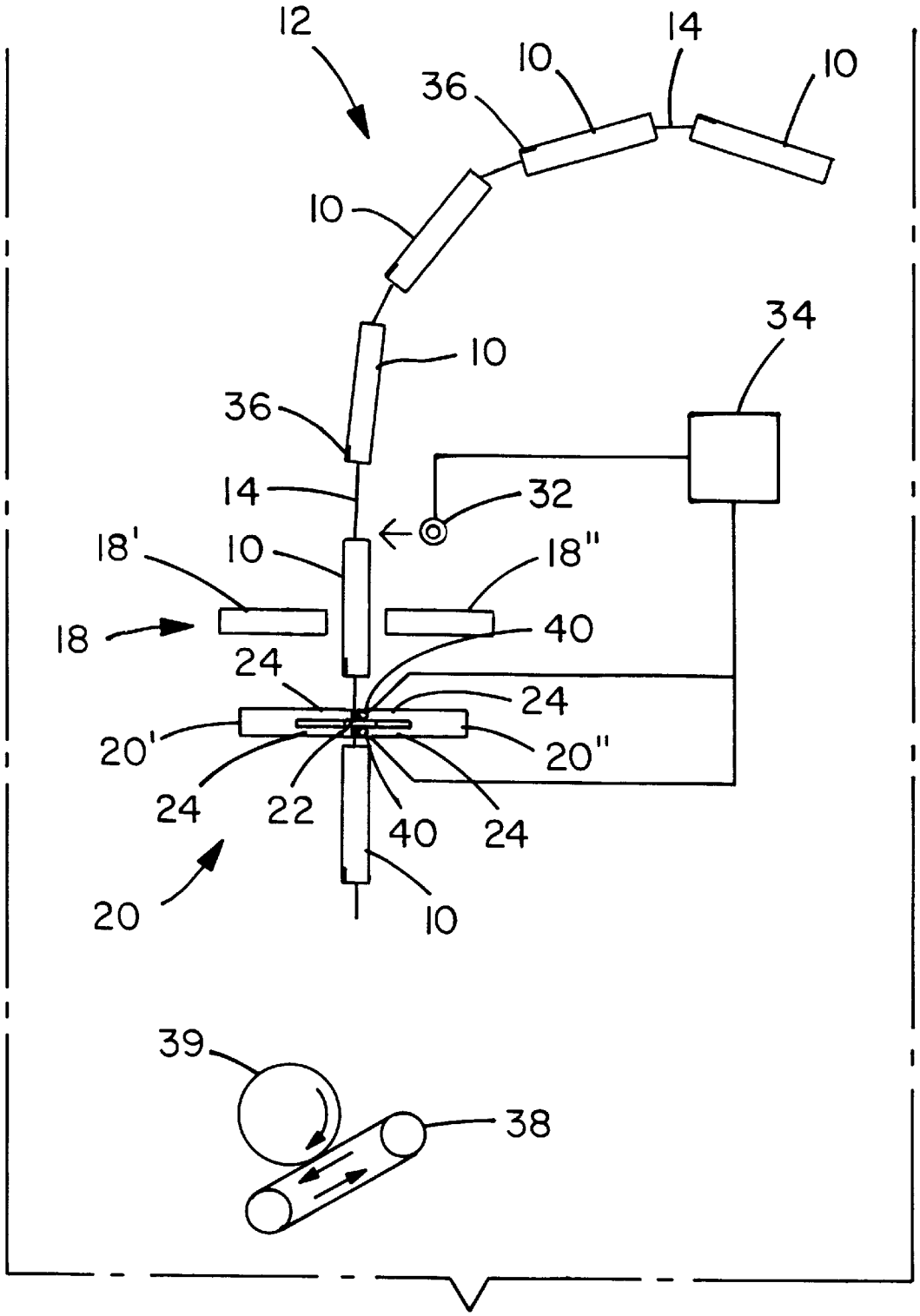
FIG. 3 is a diagram showing the continuation of the cycle of FIG. 2, wherein the pair of upper jaws are opened and the pair of lower jaws pull the bandolier of items downwardly.

In operation, a bandolier 12 of adjacent items 10 is introduced vertically into the apparatus 16. Each item is separated by a respective seam 14 from the item 10 on either side. A seam 10 is clamped between the pair of upper jaws 18 and between the pair of lower jaws 20 at an initial position. The pair of lower jaws 20 are immediately adjacent to and below the pair of upper jaws 18 since both pairs of jaws 18, 20 are clamping the same seam (FIG. 2). The at least one sensor 32 senses the identification feature and transmits a signal to the control unit 34 which activates the first means 28 to open the pair of upper jaw members 18', 18" and to activate the second means 30 to move the pair of lower jaws 20 downwardly. As the pair of lower jaws 20 grasping the seam 14 move downwardly, the bandolier 12 of items is pulled downwardly through the opened pair of upper jaw members 18', 18". As the item 10 to be separated is pulled downwardly, in the plane of the vertical movement of the bandolier 12 of items 10, the control unit 34 activates the cutting means 22 to sever the seam 14 held between the pair of lower jaws 20. The bifurcated arms 24 hold the seam 14 even though it has been severed (FIG. 3). The pair of lower jaws 20 is moved downwardly a predetermined distance. This predetermined distance is equal to at least the length between the seams in the bandolier 12 of items 14 and preferably is greater than this length.

Figure 4:
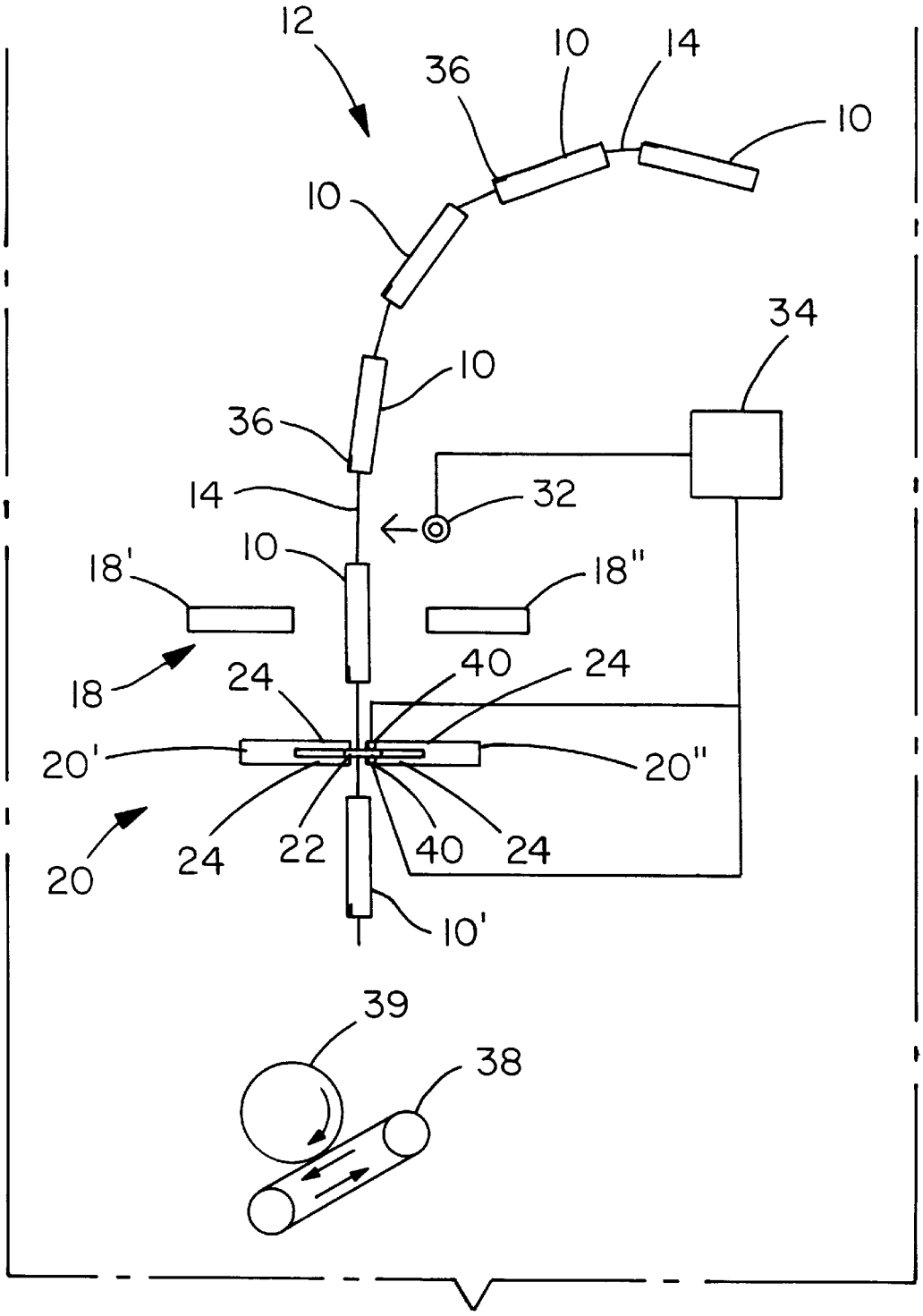
FIG. 4 is a diagram showing the continuation of the cycle of FIG. 2, wherein the cutting means remains in contact with the separated item after the lower jaws release the cut-off item.
Figure 5:
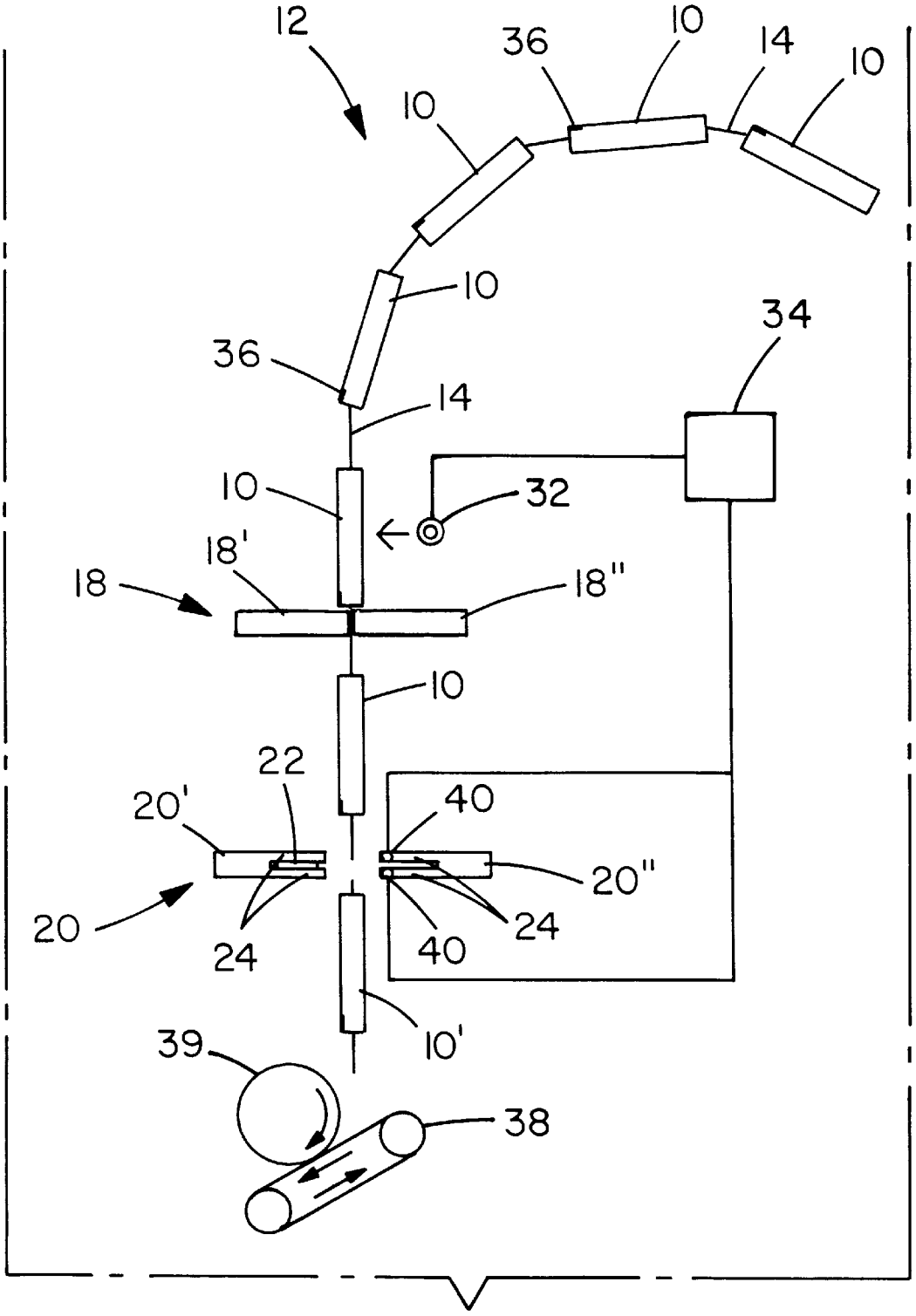
FIG. 5 is a diagram continuing the cycle of FIG. 2, wherein the pair of upper jaws are closed, the item is cut from the bandolier, the pair of lower jaws are opened and the separated item is dispensed to the delivery system.
Figure 6:
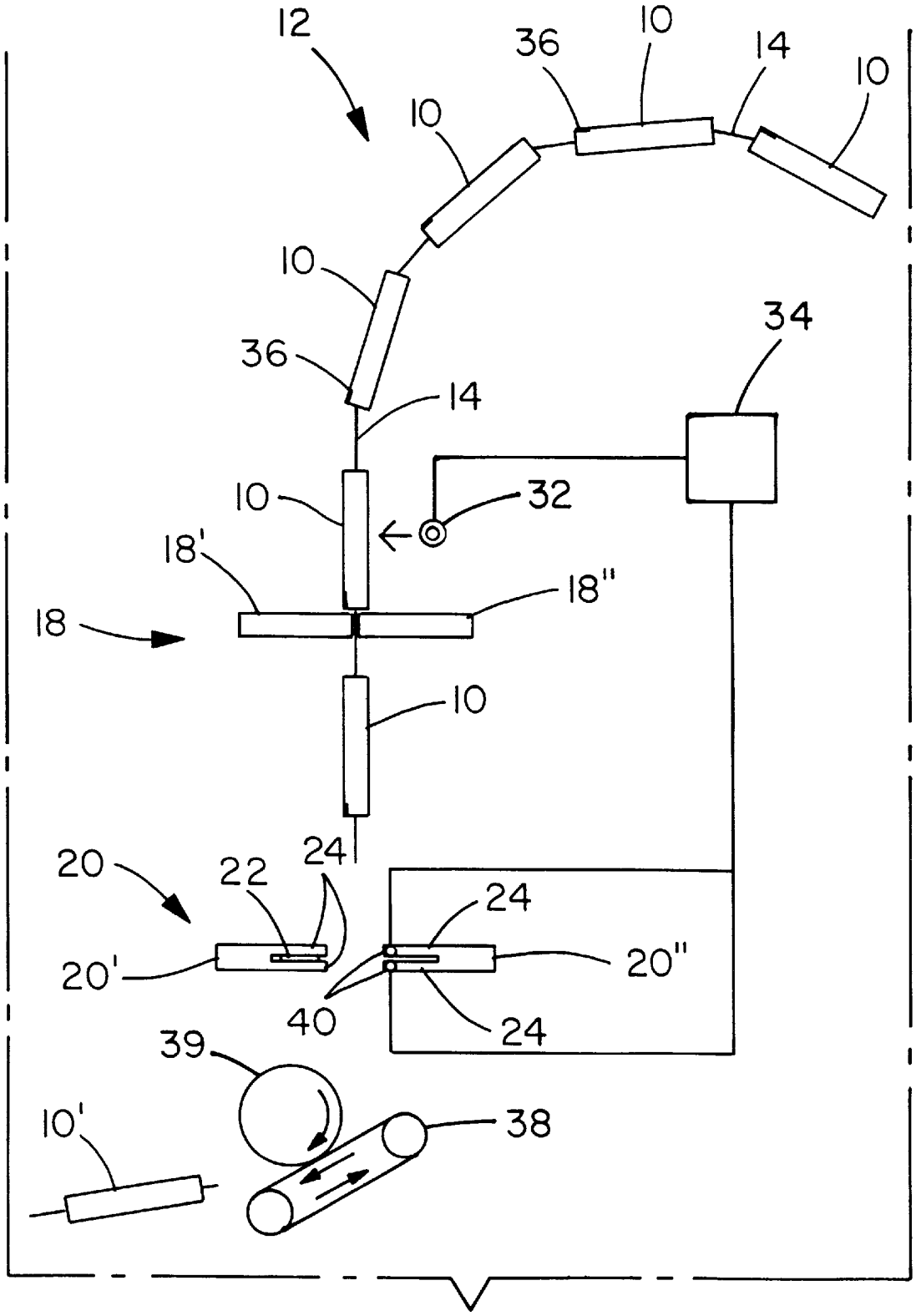
FIG. 6 is a diagram showing the cycle of FIG. 2, wherein the pair of lower jaws reaches bottom dead center and begins upward movement.
Figure 7:
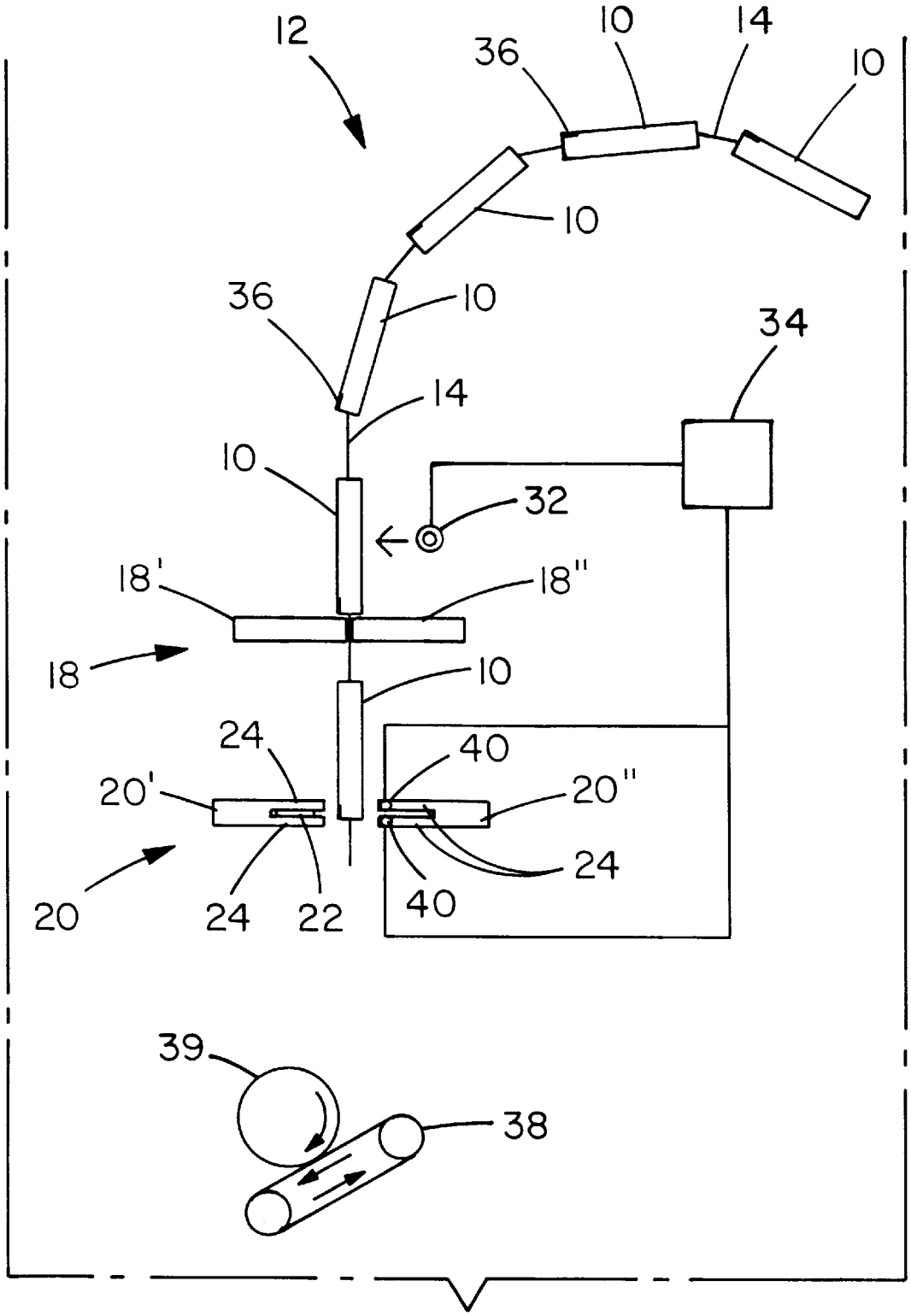
FIG. 7 is a diagram showing the cycle of FIG. 2, wherein the pair of lower jaws are moving upwardly toward the pair of upper jaws.
Figure 8:
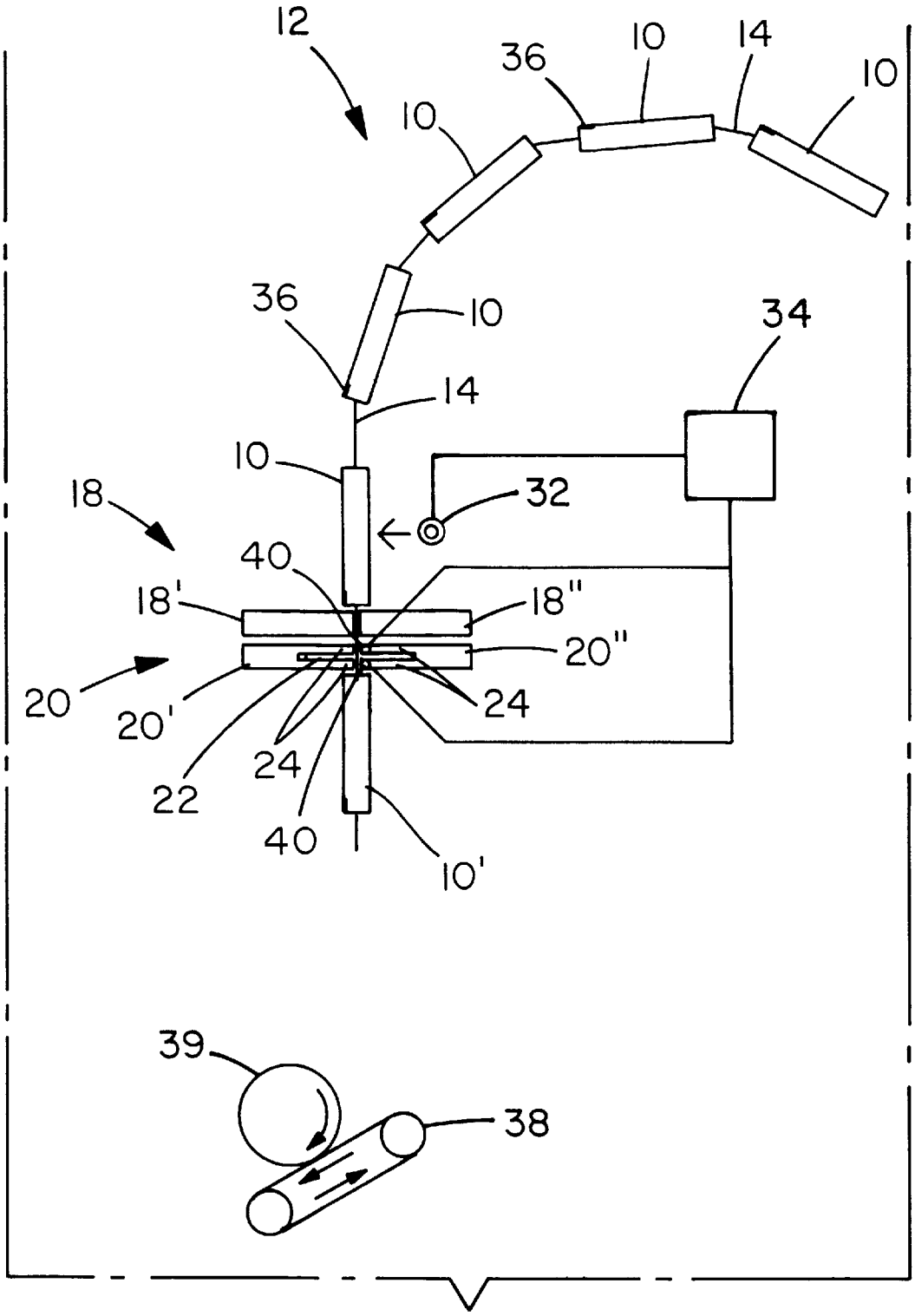
FIG. 8 is a diagram completing the cycle of FIG. 2, wherein the pair of lower jaws are moved upwardly adjacent to the pair of upper jaws and both jaws are closed on a seam.
Figure 9:
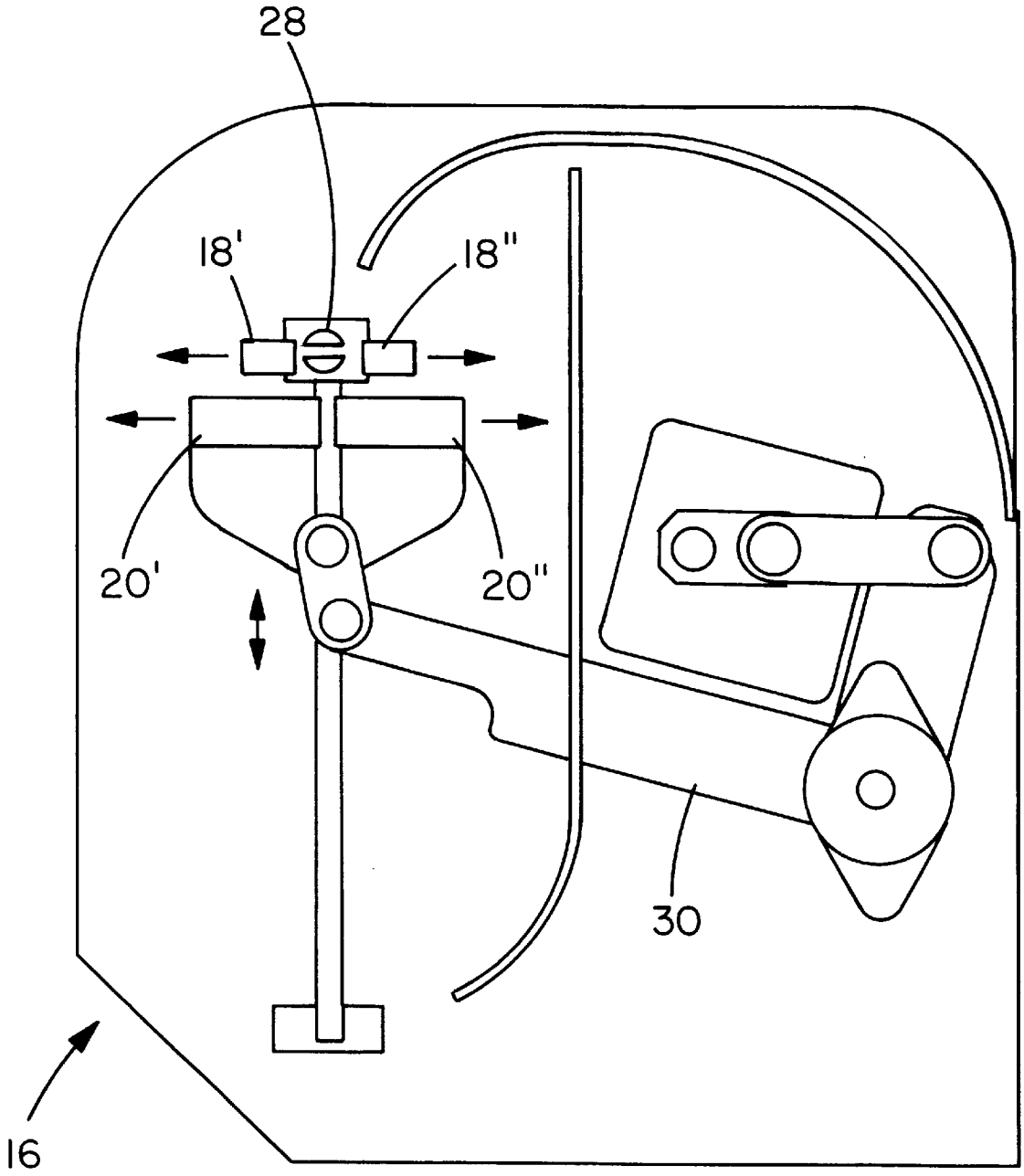
FIG. 9 is a diagram showing means to move the lower pair of jaws horizontally and vertically.

The at least one sensor 32 senses the identification feature on another item and sends a signal to the control unit 34. The control unit 34 activates the pair of upper jaw members 18', 18" to close and clamp the seam 14 on the next adjacent item 10 (FIG. 4). The pair of upper jaws 18 serve as a means for retaining the bandolier 12 when the pair of lower jaws 20 are open. When the pair of upper jaws 18 are clamped, the control unit 34 activates the pair of lower jaws 20 to open the jaw members 20', 20" and to release the separated item 10' which falls into the delivery system. The pair of lower jaws 20 continue to move downwardly for the entire predetermined distance to a lower dead center which, preferably, is greater than the length of the seams. This enables the apparatus to be used with bandoliers 12 having seam lengths within the ranges previously noted (FIG. 5). Also, the cutting means 22 remains in contact with the cut-off item 10' for a brief period of time after the pair of lower jaws 20 release the cut-off item 10'. This adds momentum to movement of time after the pair of lower jaws 20 release the cut-off item 10'. This adds momentum to movement of the cut-off item 10' to transport the cut-off item 10' to the delivery system. The pair of opened lower jaws 20 are moved upwardly (FIG. 6) and are disposed adjacent to and below the pair of closed upper jaws 18. The pair of lower jaw members 20', 20" are closed so that the seam 14 is clamped between both the pair of upper jaws 18 and the pair of lower jaws 20 (FIG. 7). The sequence as described above is repeated. In this manner, the bandolier 12 of items 10 is always clamped by at least one pair of jaws. The pair of lower jaws 20 is always below the pair of upper jaws 18 and the pairs of jaws do not pass one another in upward and downward movement. The upper jaws and the lower jaws both are opened approximately two (2) inches from the opposing member of the pair to avoid contact with the sides of the item.

The present apparatus 16 is not limited by the length of the item 10. Longer and shorter items 10 can be accommodated due to the ability of the sensor 32 to sense the identification feature on the item. Thus, the predetermined distance of movement of the bandolier 12 is adjustable and the apparatus 16 automatically compensates for the size of the item 10.

The bandolier 12 of items 10 frequently has comparatively large tolerance values in the dimensions of the items and of the seams. Thus, the operation of the at least one sensor 32 is important to assure that the operation is continuous and not erratic. It is also important that the synchronization of the movement of the jaws is maintained so that the jaws clamp only on the seams 14 and not on the items 10. It is preferred that at least a second (and, if desired, a third) sensor 40 (that is a second sensor system) be disposed adjacent to the item being separated from the bandolier. Preferably the additional sensors 40 are mounted on the bifurcated arms 24 of the other of the lower jaw member 20". Thus the second sensor system 40 is adjacent to and senses the seam 14 on the item to be separated and confirms the proper registration of the seam 14 and the item 10. The second sensor system 40 assures that the separation is only at the seam 14 by transmitting a signal to the control unit 34. In the event that the second sensor system 40 does not receive a signal due to poor quality of the bandolier, the apparatus will continue to cycle until the second sensor system 40 receives a signal. The apparatus 16 continues to operate and does not shut down. The control unit 34 does not actuate the pair of lower jaws 20 to move vertically or horizontally unless the signal(s) from the second sensor system 40 is coordinated with the signals from the at least one sensor 32. This prevents accidental clamping on and cutting of, the item 10. Accidental cutting of the item 10 not only defeats the insertion of the premium into the package, but in the case of a liquid such as catsup or a sauce as the premium, contaminates the entire apparatus necessitating shut-down to clean the jaws, cutting means and delivery system.

The apparatus 10 of the present invention is used as a component of an overall packaging assembly. It is important that the apparatus 10 be compact and easily installed in an existing system. The apparatus is approximately a 16 inch cube with externally mounted controls depending upon the available space in a particular installation. The apparatus 16 is rapid and can reliably separate and insert up to at least 150 items per minute without production shut-down.

Figure 19:
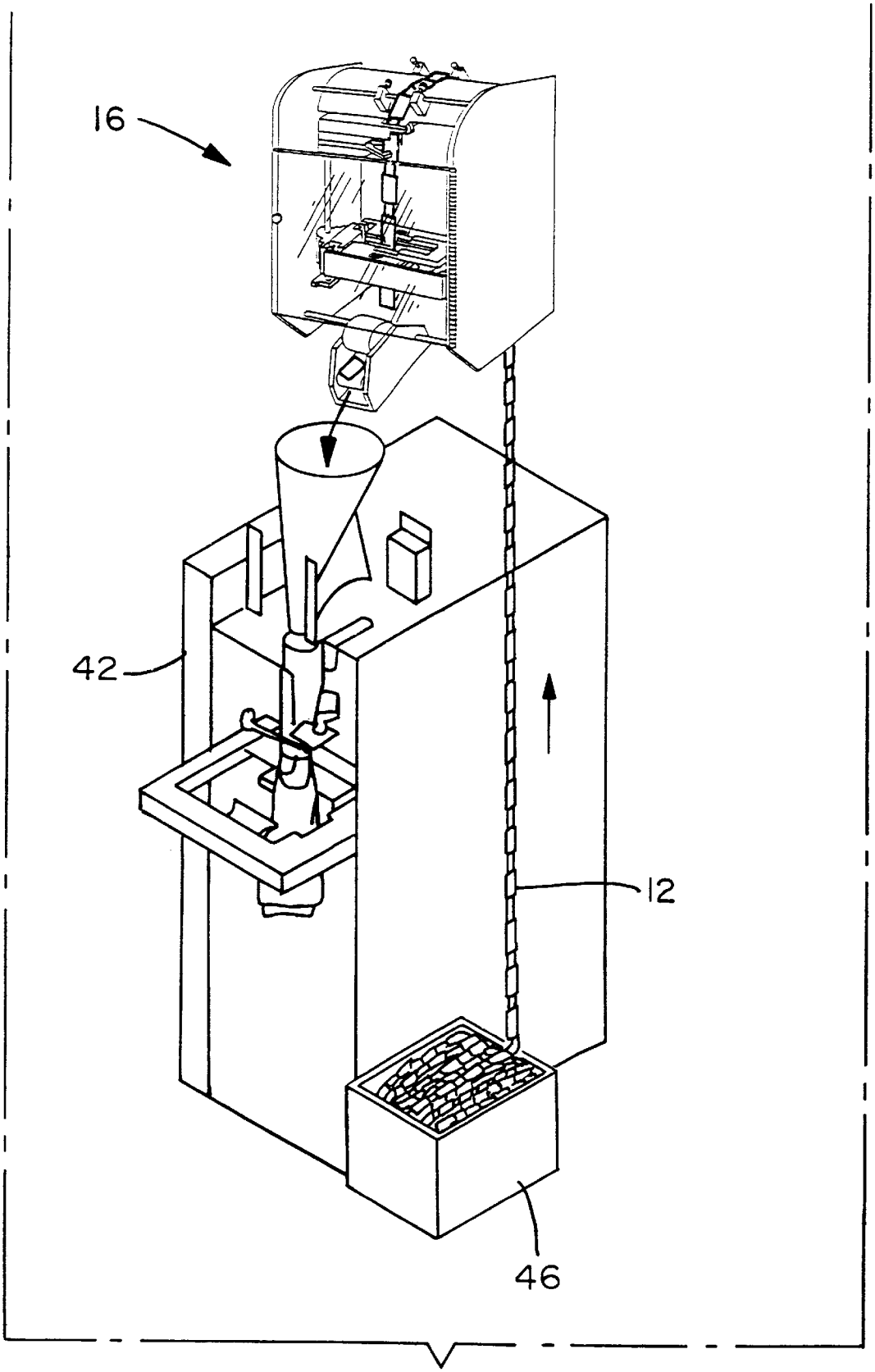
FIG. 19 is a perspective view of the apparatus of the present invention mounted on a machine for forming and sealing bags to contain a product, the item from the present apparatus being inserted into the bag concurrently with the product.
Figure 20:
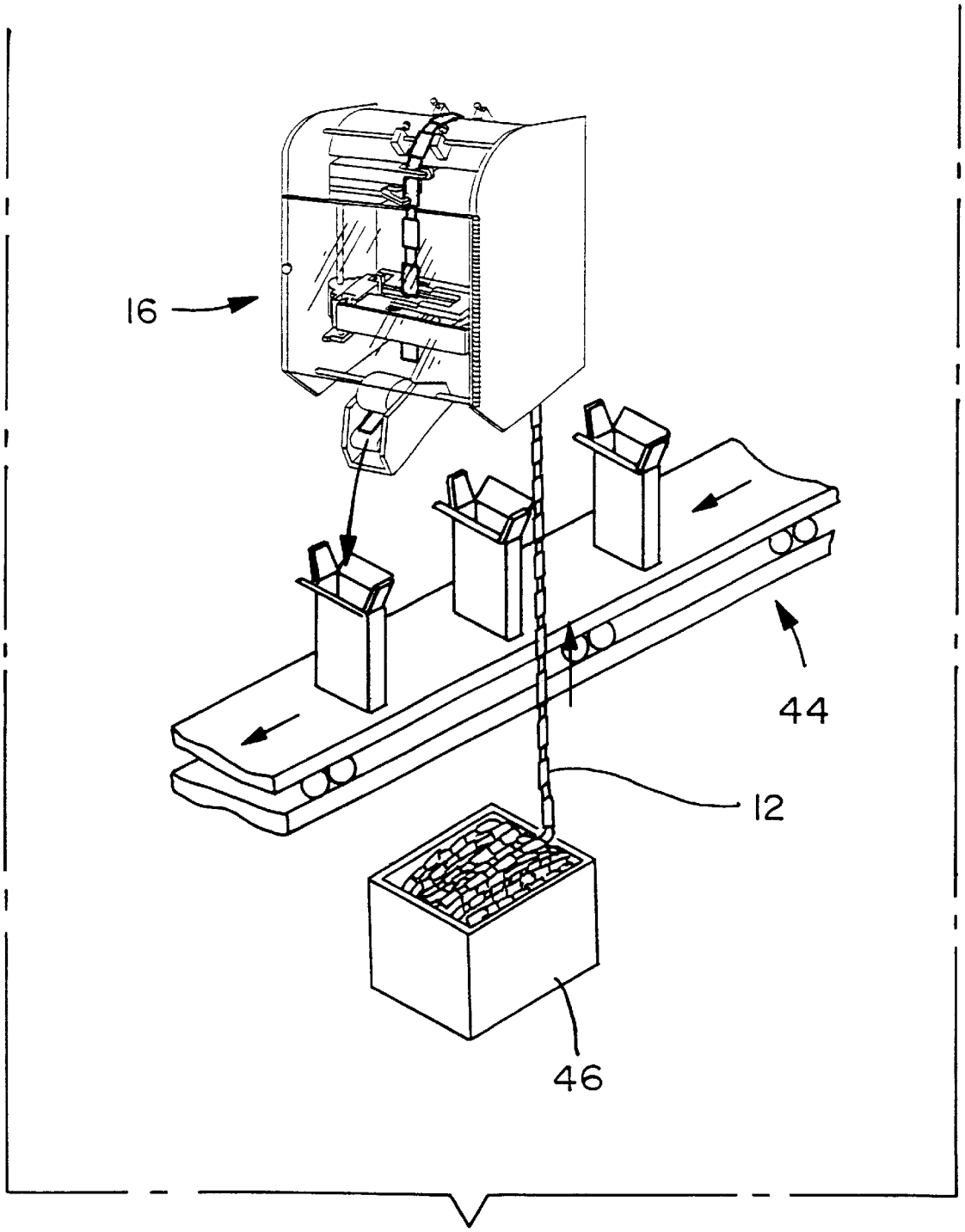
FIG. 20 is a perspective view of the apparatus of the present invention mounted above an assembly line of boxes into which are introduced items separated from the bandolier by the apparatus of the present invention.

In FIG. 19, the apparatus 16 is mounted above a standard bag-making machine 42 well known in the industry in which some parts have been omitted. In FIG. 20, the apparatus 16 is shown directing the items 10' into packages on a standard production line 44. In both FIGS. 19 and 20, the panel 35 is opened for ease of illustration. Also, the bandolier 12 is stored in a container 46 so that it is easily dispensed.

The present invention has the advantages of being relatively small and simple with few moving parts. It has one cutting means and sensors which eliminate the probability of cutting or crushing the items to be inserted. It is usable in adverse environments of heat, grease and particulates. The apparatus is reliable and relatively inexpensive. It can be used with comparatively large and heavy premium items. The apparatus automatically compensates for the size of the item in the bandolier and accommodates extremes of tolerance values in the bandolier. The cutter means remains in contact with the separated item for a brief period after the pair of lower jaws release the separated item and add momentum to transfer of the separated item to the delivery system. The apparatus operates at a production of approximately 150 items per minute. Changeovers to bandoliers having different size items is easily accomplished with minimum down-time and without substantial changeover of equipment.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a packaging apparatus, wherein a bandolier of items is fed into the apparatus, each of the items having a given length; wherein two adjacent items have a seam therebetween; separating means wherein individual items are separated, one-by-one, from the bandolier and are dispensed for insertion into respective packages; the separating means comprising:

a pair of separated opposed upper jaws and a pair of separated opposed lower jaws, the pair of lower jaws having a cutting means contained therein, the pairs of jaws each having respective jaw members disposed on opposite sides of the bandolier of items, means for moving the separate upper jaw members to reciprocate horizontally with respect to each other, such that the upper jaw members alternately close and open to clamp and release the respective seam between adjacent items, means to move the separate lower jaw members to reciprocate horizontally with respect to each other such that the lower jaw members alternately close and open to clamp and release the respective seam between adjacent items, the pair of lower jaws moving vertically downwardly and upwardly with respect to the pair of upper jaws, at least one sensor disposed adjacent to the bandolier of items and connected to a control unit for controlling movement of both pairs of jaws, wherein the pair of lower jaws clamp a respective seam on an item and move vertically downwardly from the opened pair of upper jaws, pulling the bandolier of items a predetermined distance, the seam being cut by the cutting means, the pair of upper jaw members closing, the pair of lower jaw members opening and releasing the cut-off item and the item being transported for insertion into the respective package, the pair of lower jaws moving vertically upwardly adjacent to and below, the pair of upper jaws, and clamping a respective seam between adjacent items and the sequence repeating.

2. The apparatus of claim 1, wherein the pair of upper jaws and the pair of lower jaws are closed simultaneously at the beginning of each sequence.

3. The apparatus of claim 1, wherein the pair of lower jaw members each have opposed bifurcated arms, the cutting means being disposed between the bifurcated arms on one of the lower jaw members and a void being formed between the bifurcated arms on the other of the lower jaw members such that the cutting means moves between the jaw members to cut the seam, the cutting means being received in the void in the other of the lower jaw members and returning to the one of the jaw members.

4. The apparatus of claim 1, wherein the bandolier is always clamped by at least one pair of jaws.

5. The apparatus of claim 1, wherein the means to move the respective pairs of jaws is mechanical.

6. The apparatus of claim 1, wherein the predetermined distance of pulling the bandolier of items is at least the length of the item.

7. The apparatus of claim 1, wherein the predetermined distance is adjustable to accommodate the length of the item.

8. The apparatus of claim 1, further comprising a second sensor system, the second sensor system being disposed adjacent to the item being separated from the bandolier wherein the second sensor system identifies the seam on the item to be separated and transmits information to the controller to assure that separation is only at the seam.

9. The apparatus of claim 1, wherein both upper jaw members move horizontally to open and close the clamp and release.

10. The apparatus of claim 1, wherein one of the upper jaw members moves horizontally to open and close to clamp and release.

11. The apparatus of claim 1, wherein the pair of lower jaws move downwardly to a bottom dead center after the cut-off item is released.

12. The apparatus of claim 1, wherein the cutting means remains in contact with the cut-off item for a brief period after the pair of lower jaws release the cut-off item, the cutting means adding momentum to the movement to transport cut-off items.

13. The apparatus of claim 1, wherein the cut-off item is transported by a rotating dispenser roller carried by a conveyor means wherein the cut-off item is disposed between the rotating dispenser roller and the conveyor means and is directed into the respective package.

14. The apparatus of claim 1, wherein an identification feature is provided for each item in the bandolier.

15. The apparatus of claim 14, wherein the identification feature is a registration mark formed on each item.

16. The method of severing individual items from a bandolier of items, wherein adjacent items are separated by a seam, comprising the steps of:

providing an apparatus having a pair of separated opposed upper jaws and a pair of separated opposed lower jaws, the pair of lower jaws having a cutting means contained therein, the pairs of jaws each having respective jaw members disposed on opposite sides of the bandolier of items, providing means to move the pair of upper jaw members to reciprocate horizontally to open and close with respect to one another, providing means to move the pair of lower jaws vertically downwardly and upwardly with respect to the pair of upper jaws and for the lower jaw members to reciprocate horizontally to open and close with respect to one another, introducing the bandolier of items vertically between the pair of upper jaws and the pair of lower jaws and closing both pairs of jaw members to clamp the seam between both pairs of jaws, providing at least one sensor disposed adjacent to the bandolier of items and connected to a control unit such that the at least one sensor identifies an identification feature of adjacent items in the bandolier, the at least one sensor sensing a respective first identification feature, the control unit actuating the means to open the pair of upper jaws and move the pair of lower jaws downwardly a predetermined distance, pulling the bandolier of items downwardly and cutting a first seam with the cutting means, the at least one sensor sensing a respective second identification feature, the control unit actuating the means to close the pair of upper jaw members on a second seam and to open the pair of lower jaw members such that the item cut from the bandolier falls into a delivery system, the pair of lower jaws moving upwardly to be disposed adjacent to and below the pair of upper jaws, the pair of lower jaw members closing on the second seam, and repeating the sequence of steps.

17. The method of claim 16, wherein the predetermined distance of downward movement of the pair of lower jaws is equal to at least a length between seams in the bandolier of items.

18. The method of claim 16, wherein the pair of upper jaw members close before the pair of lower jaw members open such that the bandolier of items is always clamped by at least one of the pairs of jaws.

19. The method of claim 16, wherein the identification feature of adjacent items is the seam between said items.

20. The method of claim 16, wherein the identification feature of adjacent items is a respective leading edge of said items.

21. The method of claim 16, wherein the identification feature of adjacent items is a registration mark on each item.

22. The method of claim 16, further comprising the step of providing at least a second sensor, the at least a second sensor being disposed adjacent to the item being separated from the bandolier, the at least a second sensor identifying the seam on the item being separated and transmitting information to the control unit, the control unit assuring that separation occurs only at the seam.

23. The method of claim 16, wherein both upper jaw members move horizontally to open and close to clamp and release.

24. The method of claim 16, wherein one of the upper jaw members moves horizontally to open and close to clamp and release.

25. The method of claim 16, wherein the pair of lower jaws move downwardly to a bottom dead center after the cut-off item is released.

26. In a packaging apparatus, wherein a bandolier of items is fed approximately vertically into the apparatus, each of the items having a given length and opposing faces; wherein two adjacent items have a seam therebetween; separating means wherein individual items are separated, one-by-one, from the bandolier and are dispensed for insertion into respective packages; the separating means comprising:

a pair of separated opposed jaws, the pair of jaws having a cutting means contained therein, the pair of jaws having respective jaw members disposed on opposite faces of the bandolier of items, means to move the respective jaw members to reciprocate horizontally with respect to each other such that the jaw members alternately close and open to clamp and release the respective seam between adjacent items at an initial position, the pair of jaw members moving vertically downwardly and upwardly with respect to the bandolier of items, at least one sensor disposed adjacent to the bandolier of items and connected to a control unit for controlling movement of the pair of jaws, means for retaining the bandolier of items when the jaw members are open, wherein the pair of jaw members clamp a respective seam on an item and move vertically downwardly from the retaining means, pulling the bandolier of items a predetermined distance, the seam being cut by the cutting means to provide a cut-off item, the pair of jaw members opening during the downward movement of the jaws, the cutting means remaining in momentary contact with the cut-off item to add momentum to movement of the cut-off item from the opened jaws, the item being transported for insertion into the respective package, the pair of jaws moving to a bottom dead center position and thereafter moving vertically upwardly to the initial position and clamping another respective seam between two other adjacent items, and the sequence repeating.

* * * * *